United States Patent [19]

Orszulak

[11] Patent Number: 5,051,743

[45] Date of Patent: Sep. 24, 1991

[54] HIGH PRECISION, HIGH FREQUENCY CURRENT SENSING AND ANALOG SIGNAL DECODING NETWORK

[75] Inventor: James H. Orszulak, Nederland, Colo.

[73] Assignee: Ball Corporation, Muncie, Ind.

[21] Appl. No.: 359,408

[22] Filed: May 31, 1989

[51] Int. Cl.[5] ..... G08C 19/10; G08C 19/22

[52] U.S. Cl. ..... 340/870.04; 340/870.37; 340/870.17

[58] Field of Search ..... 340/870.37, 870.04, 340/870.05, 870.17, 870.21; 364/561, 573; 73/701

[56] References Cited

U.S. PATENT DOCUMENTS

| | | | |
|---|---|---|---|
| 3,975,719 | 8/1976 | Frick | 340/870.37 |
| 4,205,327 | 5/1980 | Dahlke | 340/870.39 |
| 4,219,740 | 8/1980 | Little | 307/116 |
| 4,296,413 | 10/1981 | Milkovic | 340/870.38 |
| 4,502,003 | 2/1985 | Frick | 323/275 |
| 4,532,510 | 7/1985 | Bertrand et al. | 340/870.17 |
| 4,570,490 | 2/1986 | Antonazzi | 73/701 |
| 4,584,885 | 4/1986 | Cadwell | 340/870.37 |
| 4,590,472 | 5/1986 | Benson et al. | 340/870.04 |
| 4,783,659 | 11/1988 | Frick | 340/870.37 |

*Primary Examiner*—Donald J. Yusko
*Assistant Examiner*—Yuk H. Lav
*Attorney, Agent, or Firm*—Sheridan, Ross & McIntosh

[57] ABSTRACT

An apparatus and method are provided for performing parametric measurements using sensor transducer devices to recover frequency variant, amplitude modulated information from encoded sensory signals. A unique network is employed to achieve low-impedance current sensing in conjunction with analog signal decoding. More particularly, the network includes a circuit for current sensing the desired parameter and providing an analog sensor output signal related to the unit measure (i.e., relative value) of the desired parameter. The network also includes a circuit for receiving the demodulating the sensor output signal to obtain a signal representing the electrical equivalence of the measured parameter. The circuit for demodulating employs synchronous sampling techniques and includes a subcircuit, closed-loop through which the demodulated output is fed for generating an offset or error correcting signal. The offset signal is combined with the sensor output signal to generate a resultant signal reflecting static and dynamic changes in the parameter of interest.

27 Claims, 2 Drawing Sheets

HIGH PRECISION, HIGH FREQUENCY CURRENT SENSING AND ANALOG SIGNAL DECODING NETWORK

FIELD OF THE INVENTION

The present invention relates to a network which employs unique techniques and processes to generate high precision, high frequency, temperature stable parametric measurements, and in particular, to an apparatus and method capable of broadband high frequency operation, using both amplitude and phase correlated demodulation processing, to obtain static and dynamic parametric measurements. More particularly, AC sensory current signals are converted to DC output signals for correlated static measurements, and further, AC output signals are generated for correlated dynamic measurements. The DC and AC output signals represent processed electrical equivalence output reflecting both static and dynamic positional movements of an object with a high degree of accuracy.

BACKGROUND OF THE INVENTION

Many situations exist wherein the sensing of telemetric parameters, such as distance, is desirable. Frequently, the magnitude of the parameter is sensed with an electrical implementation including a sensor (e.g. transducer) having an impedance which varies as a function of magnitude changes in the sensed parameter. Changes in the magnitude of sensor impedance may be small so that electrical noise generated by the sensing implementation can diminish resolution considerably. Moreover, it is often necessary to process the sensed signal and transmit the same over a relatively long path to receiving apparatus. Hence, it is often desirable to employ circuitry which minimizes noise and optimizes both processing and transmission of the sensed signal.

Various known implementations employing sensory transducer devices, such as reflected impedance transducer (RIT) devices, employ a capacitively tuned transducer bridge to achieve high precision linear performance. Such implementations are subject to error due to the destructive interaction and environmental sensitivity of necessary capacitive components. Additionally, such implementations typically necessitate electronics that display a high input impedance to sense and recover voltage changes. High input impedances render the device susceptible to external radiated energy influences (i.e. noise pick-up errors).

U.S. Pat. Nos. to Frick (3,975,719; 4,502,003 and 4,783,659) generally relate to circuitry for processing a current signal from a transducer or sensor. In particular, the Frick '719 patent is directed to a two-wire transmitter providing a current signal proportional to a variable reactance to be measured. In the preferred embodiment, the two-wire current transmitter comprises an input circuit, a current control circuit, and an excitation circuit. The input circuit, which includes a varying capacitor $C_1$ and a reference capacitor $C_2$, provides a rectified DC current signal which is substantially proportional to the expression $C_2/C_1$ and includes zeroing and linearizing features. The current control circuit provides energization for the input circuit and allows for control of a total current signal which is communicated to the current control circuit by way of the excitation circuit. More particularly, the total current signal varies as a function of the variable reactance.

The Frick '003 patent relates to a two-wire circuit having span means in a total current control feedback loop. In the preferred embodiment, the two-wire circuit includes a power source, coupled to first and second terminals, as well as feedback amplifier means and current control means. The first terminal communicates with the feedback amplifier means and the second terminal communicates with current control means including a sensor. The span means which is coupled to the feedback amplifier means, receives the amplified feedback signal and adjusts the amplified feedback signal as desired such that the total current is controlled by the current control means as a function of at least the sensor signal and the adjusted amplified feedback signal.

The Frick '659 patent relates to a transmitter in which analog correction signals are provided based upon stored digital correction values. In one embodiment, signals from a sensor and an analog array switch are inputted to an integrator where they are integrated and combined to form a signal $V_s$, which is related to a sense signal. A feedback signal relating to $V_s$ is communicated to the analog switch array and a microcomputer via a comparator. The microcomputer controls a D/A converter by inputting digital correction values thereto. In turn, the D/A converter provides pulse width modulated outputs having duty cycles based upon corresponding digital inputs received from the microcomputer. Outputs from the D/A are shared directly between a drive/clock, the analog switch array and the integrator.

Although the above-noted patents represent advances in the field of sensing and decoding networks, they do not adequately address the growing need for implementations which can both accommodate broadband operating frequency sensory ranges and maximize accuracy. More specifically, a need exists for a network with broadband frequency performance having the capability to obtain results that are both highly precise and accurate, as well as results that are stable over a substantial range of operating temperatures.

SUMMARY OF THE INVENTION

The present invention relates to a network employing low-impedance current sensing and analog signal decoding to measure desired parameters. The network includes a means for sensing the desired parameter and providing a differential sensor output signal related to the unit measure (i.e. relative value) of the desired parameter. The network further includes a means for demodulating which receives the sensor output signal and yields a demodulated output signal having an amplitude representing an electrical equivalence of the desired parameter. The demodulating means includes a means for dynamically generating an offset or error correcting signal proportional to the amplitude of the demodulated output signal, and means for combining the offset signal with the sensor output signal to provide a resultant signal such that changes in the magnitude of the sensor output signal can be dynamically monitored and measured.

In the preferred embodiment, the sensory means includes RIT sensors to measure a desired telemetric parameter(s) (e.g. relative position of an object). Carrier signal control means are provided to control operation of the sensors at a pre-determined carrier frequency. The demodulating means includes means for sampling the aforementioned resultant signal to generate a sampled signal. Operation of the sampling means is preferably synchronized with the carrier signal control means so that the resultant signal is sampled at predetermined intervals to accurately obtain high accuracy peak values. This sampling operation facilitates phase correlated demodulation. The output of the sampling means drives an integrator and a proportional output signal is fed back through the aforementioned generating means to the combining means at an input of the demodulating means. Due to use of a closed feedback loop and sampling arrangement, the demodulating means has the ability to respond to dynamic positional movements of an object, represented by changes in the resultant signal, with a high degree of accuracy. The resultant signal is thereafter transmitted from the combining means through the demodulating means. If the amplitude of the sensor output remains unchanged, the magnitude of the resultant signal is substantially equal to an initial reference value, e.g., zero, and the amplitude of the demodulated output signal remains substantially constant. If the amplitude of the sensor output signal changes, the magnitude of the resultant signal will change, thereby driving the integrator, and changing the amplitude of the demodulated output signal to reflect the electrical equivalence of the unit measure change in the sensed parameter.

Numerous advantages of the present invention will be appreciated by those skilled in the art.

One advantage of the invention is that it presents a unique direct drive operating format to establish quiescent operation of the sensing means without using a transducer bridge network. Thus, excessive bridge network componentry contributing to output signal drift error is eliminated.

A further advantage of the invention is that the low impedance nature of the sensing means serves to substantially minimize cabling capacitance drift and leakage effects over operating temperature, thus offering greater flexibility of design while precisely maintaining optimal levels of quiescent operation and accuracy of performance. By minimizing cabling capacitance drift and leakage effects, sensor signal current integrity is maximized.

Another advantage of the invention is that the network is not burdened by the task of common mode rejection of large signal amplitude carrier signals. That is, the carrier signal is common mode rejected to the highest degree possible by the sensing means such that the accuracy of the demodulated output signal is substantially increased.

A still further advantage of the invention is that, since the sampling means is synchronized with the carrier signal control means, phase-related changes present in the sensor output signal are automatically detected and tracked by the sampling means.

Another advantage of the invention is that sampling occurs in a net zero volts recovered charge mode (i.e.,'-'zero volt mode"). Accordingly, the capacitive charge leakage effects are minimized and the dynamic range of temperature performance is maximized.

It is yet another advantage of the invention that, for most parametric measurement applications, the central frequency and bandwidth of the demodulated output signal can be provided approximately two orders of magnitude lower than that of the carrier signal frequency. This, of course, allows for high accuracy, dynamic measurements.

An additional advantage of the invention is that use of a feedback loop in the demodulating means allows for an increased operating temperature range, compensation of sampling drift errors and proper dynamic range scaling of the network. Consequently, for example, automatic compensation and control are provided for sampling switch resistance changes occurring over wide temperature operation.

Another advantage of the invention is that linear response of the network can be achieved to a minimum of 11 BIT precision (i.e. one part in 2048), or better.

An additional advantage of the invention is that gain control of the sensed, or recovered, AC signal at the input of the demodulating means is automatically achieved by use of a feedback loop. Further, operating temperature variations can be dynamically accounted for due to the use of the feedback loop. Thus, the network is substantially stable from both gain and operating temperature standpoints.

A still further advantage of the invention is that output voltage stability of the network is enhanced through employment of digital-to-analog converters (DACs) for control of gain and offset.

It is yet another advantage of the invention that operating frequency detection ranges from DC to 500 kHz can be realized.

It is further an advantage of the invention that design flexibility of the network allows for the sensor to electronics interface and for demodulated output signal to be transmitted over long source and load distances while maintaining high levels of precision.

These and other features, advantages and objects of the present invention will be further understood and appreciated by those skilled in the art by reference to the following description, and drawings and claims.

DETAILED DESCRIPTION OF THE PREFERRED EMBODIMENT

Figure 1:
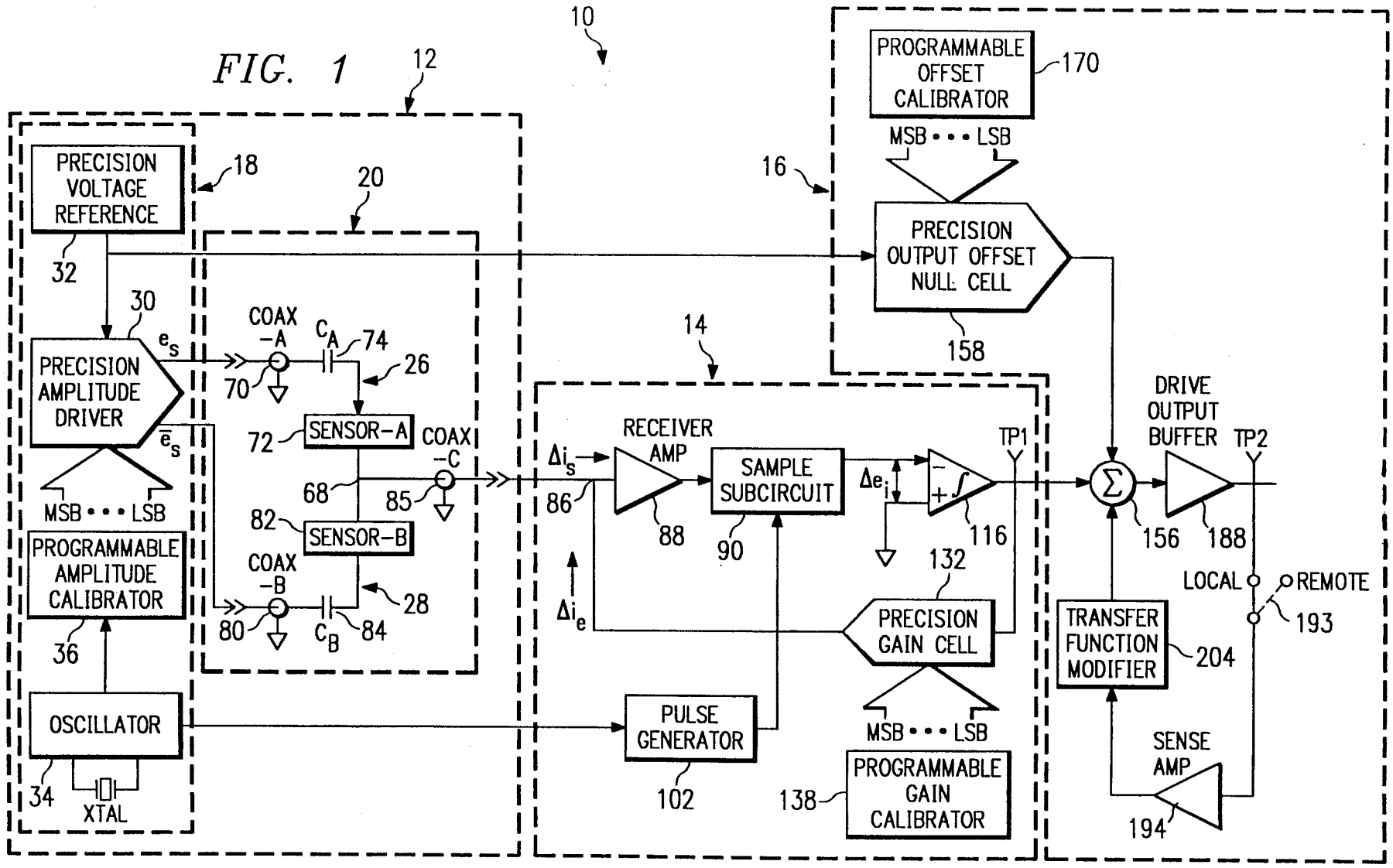
FIG. 1 is a block diagram embodying the present invention and depicting a high-precision, high-frequency, temperature stable network, which employs low-impedance current sensing and analog signal decoding to measure a desired parametric value(s)

For purposes of description herein, the terms "upper", "lower", "right", "left", "rear", "front", "vertical", "horizontal", and derivatives thereof shall relate to the invention as oriented in the drawings attached herewith. However, it is to be understood that the invention may assume various alternative orientations and set sequences, except where expressly specified to the contrary. It is also to be understood that the specific devices and processes illustrated in the attached drawings, and described in the following specification, are simply exemplary embodiments of the inventive concepts defined in the appended claims. Hence, specific physical characteristics relating to the embodiments disclosed herein are not to be considered as limiting unless the claims by their language expressly state otherwise.

The reference numeral 10 (FIG. 1) generally represents a high precision network for sensing and demodulating an analog signal to recover frequency variant, amplitude modulated data from high frequency carrier signals present in sensory transducer devices. Network 10 comprises a sensing circuit 12, demodulating circuit 14 and signal processing circuit 16. Sensing circuit 12 includes a drive circuit 18 operatively connected to a sensor circuit 20. Source drive signals $e_s$ and $\bar{e}_s$ are outputted from the drive circuit 18 via lines 26 and 28 to establish high frequency operation in sensor circuit 20. In the present example, $e_s$ and $\bar{e}_s$ have the same magnitude and frequency but are phase shifted with respect to one another by 180°.

Figure 2:
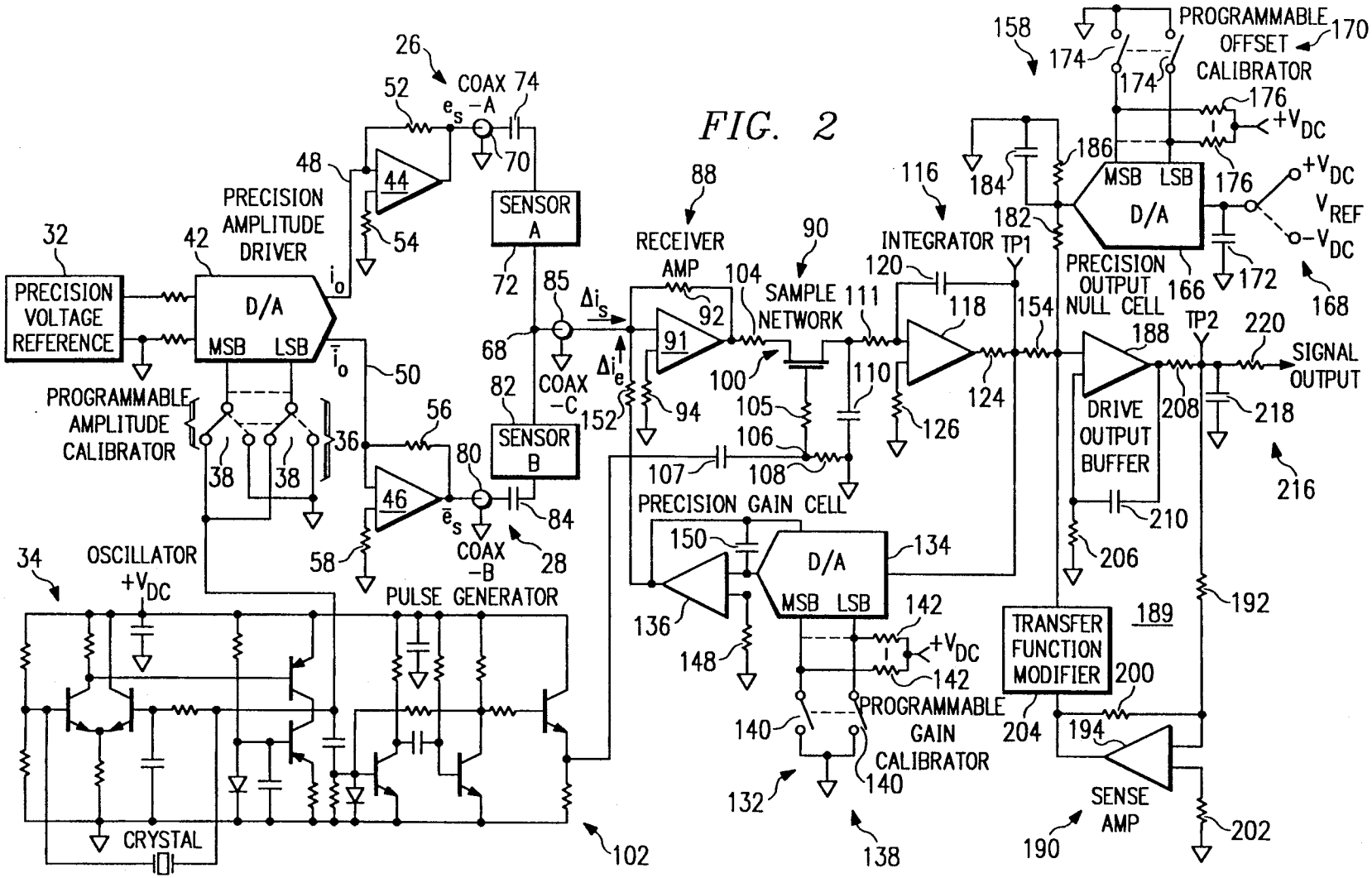
FIG. 2 depicts a circuit diagram of the network shown in FIG. 1.

Central to the operation of drive circuit 18 (FIG. 1) is a precision amplitude driver 30 receiving inputs from a precision voltage reference 32 and a crystal oscillator 34. Conventional componentry is employed to construct precision voltage reference 32 and crystal oscillator 34. While a circuit diagram of crystal oscillator 34 is illustrated in FIG. 2, its construction is conventional and will not be discussed in any detail herein. As should be appreciated, precision voltage reference 32 is preferably a band gap precision voltage reference device which establishes the precision amplitude level capability for $e_s$ and $\bar{e}_s$, as well as providing a high degree of driver amplitude stability over a considerable range of operating temperature. Additionally, crystal oscillator 34 provides a high accuracy constant frequency signal for controlling the precision frequency output of $e_s$ and $\bar{e}_s$.

A programmable amplitude calibrator 36 receives the output of crystal oscillator 34, and imparts amplitude adjustment to $e_s$ and $\bar{e}_s$. As best illustrated in FIG. 2, programmable amplitude calibrator 36 is effected through employment of a set of switches 38, which communicate the output of crystal oscillator 34 with the input of precision amplitude driver 30. Setting of switches 38 allows for digitized programming of the output of the precision amplitude driver 30. In the preferred embodiment, programmable amplitude calibrator 36 affords precision incremental output adjustment of $e_s$ and $\bar{e}_s$. As should be appreciated by those skilled in the art, programmable amplitude calibrator 36 further serves to maintain inherent source drive signal amplitude stability.

The precision amplitude driver 30 (FIGS. 1 and 2) comprises a digital-to-analog converter (DAC) 42 of conventional construction, communicating with operational amplifiers 44 and 46 via lines 48 and 50. Operational amplifier 44 includes a feedback resistor 52 and is interconnected with ground by way of resistor 54. Operational amplifier 46 includes feedback resistor 56 and is interconnected with ground via resistor 58. The operational amplifiers 44 and 46 optionally provide gain for $i_o$ and $\bar{i}_o$ while converting the same to $e_s$ and $\bar{e}_s$, respectively.

AC drive source signals $e_s$ and $\bar{e}_s$ are communicated to sensor circuit 20 (FIGS. 1 and 2) via the two abovementioned lines 26 and 28 which are joined at node 68. Line 26 includes a coaxial line 70 which is coupled to a sensor 72 via a capacitor 74. Line 28 includes a coaxial line 80 which is coupled to a sensor 82 via a capacitor 84. It should be appreciated that the capacitance values of capacitors 74 and 84 should preferably be selected in matching relation to the impedance characteristics of sensors 72 and 82, respectively, at the desired operating carrier frequency. As a result of the impedance matching, precision linearity compensation is achieved. This eliminates parasitic non-linear performance effects of cabling capacitance tuning, a technique often employed. As explained in further detail below, a net difference AC current ($\Delta i_s$) is transmitted from sensor circuit 20, through coaxial line 85 and node 86, to demodulating circuit 14.

In the preferred embodiment, sensors 72, 82 constitute a complimentary pair of reflected impedance transducer (RIT) devices. As is well known in the art, RIT devices can be employed to measure sensor to object distances. For example, RIT devices can be used to measure/control fast-steering mirror linear distances. Typically RIT devices operate at a high frequency, e.g., 500 kHz, to establish proper magnetization coupling between sensory heads and objects of interest. While in the preferred embodiment the sensors are of an RIT type, operation of network 10 is not limited to RIT devices. For example, in other applications requiring sensing and decoding with high precision, other devices, such as capacitive sensor probes or other sensory devices, could be suitably employed. As is known capacitive probes, which typically operate at approximately 6 kHz, find application in fuel tanks and other arrangements, and could be employed with the present invention..

As will be appreciated from the discussion above, sensing circuit 20 does not employ bridge network components. Thus, parasitic non-linear performance effects caused by drift and cabling capacitance tuning of cabling are eliminated. Moreover, use of a net difference current, i.e. $\Delta i_s$, removes the need to common mode reject a large signal amplitude carrier signal within demodulating circuit 14.

Demodulating circuit 14 (FIGS. 1 and 2) includes a receiving amplifier as having its output connected to a sampling sub-circuit 90. As illustrated in FIG. 2, receiving amplifier 88 includes an operational amplifier 91 having a feedback resistor 92 and a resistor 94 interconnecting the non-inverting input of operational amplifier 91 with ground. The receiving amplifier 88 is preferably operable in a zero volt mode.

In the preferred embodiment, sampling sub-circuit 90 comprises a JFET 100 (FIG. 2) interconnected with a pulse generator 102. JFET 100 could, for example, be of a gallium-arsenide construction for high precision operation. As will be appreciated by those skilled in the art, however, other components, such as a MOSFET, could be used in place of a JFET without significantly affecting the high precision operation of sampling sub-circuit 90. Resistors 104 and 105 are interconnected to the drain and gate of JFET 100, respectively. The input terminal of pulse generator 102 is interconnected with the output of crystal oscillator 34. In the preferred embodiment, pulse generator 102 is signal-edge triggered relative to crystal oscillator 34, assuring accurate synchronous phase detection over a considerable range of operating temperature. Consequently, dynamic phase correlated demodulation is facilitated, with peak values of the AC output transmitted from receiving amplifier 88 being selected, i.e. "picked off", for conversion to DC stimuli by sampling sub-circuit 90. Output of pulse generator 102 is coupled to a node 106 via a capacitor 107. Node 106 is interconnected with ground by a resistor 108. Additionally, the source of JFET 100 is interconnected with ground, via a capacitor 110, and integrator 116, via a resistor 111.

Integrator 116 (FIG. 2) includes a conventional arrangement employing an operational amplifier 118 with a feedback capacitor 120. In the present example, integrator 116 also has an output resistor 124 and a resistor 126 interconnecting the non-inverting end of operational amplifier 118 with ground. The voltage difference between the inverting and noninverting inputs of operational amplifier 118 is designated as $\Delta e_i$. As will be explained in further detail below, output from sampling sub-circuit 90 drives integrator 116 when $\Delta e_i$ is nonzero.

Output of integrator 116 at TP1, i.e., $V_{TP1}$, is fed back across feedback capacitor 120 and precision gain cell 132. In the preferred embodiment, precision gain cell 132 includes a DAC 134 (FIG. 2) and an operational amplifier 136. Digital programming of precision gain cell 132 is provided by a programmable gain calibrator 138 comprising a set of switches 140, each of which is connected in series with a resistor 142 and a DC voltage source. In the preferred embodiment, programmable gain calibrator 138 affords 12 bit precision relative to its output. The operational amplifier 136 includes a resistor 148, interconnecting the non-inverting input of operational amplifier 136 to ground, and a feedback loop including a capacitor 150. Portions of the output of operational amplifier !36 are fed back to the inverting input of operational amplifier 136, through the capacitor 150, and the DAC 134. The output of precision gain cell 132 is communicated to node 86 across resistor 152.

Precision gain cell 132 has a linear transfer function operating at a predetermined gain and not only monitors $V_{TP1}$, providing linear gain amplification, but converts the integral variant voltage at TP1 to a proportional offset current, i.e. $\Delta i_e$. The offset or error correcting current, $\Delta i_e$, which dynamically tracks $\Delta i_s$, is continuously fed back to node 86. The offset current is combined with, or offset from, $\Delta i_s$ at node 86 to yield a resultant current which is inputted to receiving amplifier 88. As the resultant current is applied to the input of receiving amplifier 88, the output peak to peak voltage of the receiving amplifier 88 is level shifted when $\Delta i_s$ fluctuates in magnitude. As a result of the above-described feedback, the demodulating circuit 14 is provided with the ability to respond to positional movements of an object, represented by changes in the resultant signal, dynamically and with a high degree of accuracy. The circuitry for combining the offset signal $\Delta i_e$ with the sensing signal $\Delta i_s$ is conventional.

Decoded output from demodulating circuit 14 (FIGS. 1 and 2) is transmitted to signal processing circuit 16 across a- resistor 154. Three signals, including, as the firs- signal, the above-noted decoded output, are combined at a summer 156. The second signal to summer 156 is transmitted from precision output offset null cell 158 providing a calibrated DC voltage bias for setpoint reference to the signal present at the output of signal processing circuit 16, i.e. TP2. In one example, precision output offset null cell 158 is a DAC 166 having two inputs, namely a voltage reference 168 and a programmable offset calibrator 170. As illustrated in FIG. 2, the output of voltage reference 168 is interconnected with ground via capacitor 172, and the voltage reference 168 is adapted to be switched between a positive DC voltage level and a negative DC voltage level. As illustrated in FIG. voltage reference 168 can optionally be supplied through employment of precision voltage reference 32.

The programmable offset calibrator 170 (FIG. 2) comprises a set of switches 174, each of which is connected in series with a resistor 176 and a DC voltage source. In the preferred embodiment, programmable offset calibrator 170 affords 12 bit precision relative to its output. Output from DAC 166 is directed across a resistor 182, as well as a capacitor 184 and resistor 186, both of which are interconnected to ground. As should be appreciated, the second signal generated by precision output offset null cell 158 serves to maintain stability of adjustment for the network 10 over a total system control range.

The third signal +o summer 156 (FIGS. 1 and 2) is derived from output of a drive output buffer 188 transmitted through a feedback loop 189. The feedback loop 189 includes a sense amplifier 190 interconnected with an input resistor 192. In the present example, the predetermined operation of amplifier 190 may be facilitated through use of a sense switch 193 (FIG. 1) which may be set to provide for local sense or a remote sense. Sense amplifier 190 (FIG. 2) includes an operational amplifier 194 having a feedback resistor 200 interconnected with its inverting input and a resistor 202 interconnecting the non-inverting input with ground. As should be appreciated, sense amplifier 190 and sense switch 193 are cooperatively employed to provide for accurate and precise transmission of the output of network 10 over load distances.

The output of sense amplifier 190 communicates with a transfer function modifier 204 (FIG. 1 and 2), which offers dynamic characteristic curve modification to the signal developed at TP1 over the two quadrant range of output voltage amplitude. As will be appreciated by those skilled in the art, the componentry employed to effect transfer function modifier 204 could range from a linear component, such as a resistor, to a series of active components, such as operational amplifiers, capable of operation in accordance with desired mathematical functions By employing the transfer function modifier 204 within the feedback loop 189, the net resultant TP2 transfer function response is optimized for stability over a considerable range of operating temperature. Additionally, the transfer function modifier 204 serves to provide fine adjustment for linear compensation of network 10. By way of example, in applications involving RIT monitoring of angular (i.e. rotational) mirror position travel (e.g. fast steering mirror systems), the transfer function modifier 204 can provide cosine correction stimulus to TP1 to relinearize the network 10, thus compensating for angular displacement sense errors. Accordingly, the output of network 10 represents a linearized response to the mirror's angular travel.

The three above-mentioned signals are combined at summer 156 and transmitted to an input of drive output buffer 188. A second input of buffer 188 is interconnected to ground via a resistor 206. The output of buffer 188 is divided among an output resistor 208 and a feedback capacitor 210 Signal output of network 10 is transmitted through line 216 which is represented by capacitor 218 and resistor 220.

In operation, the precision amplitude driver 30, via the programmable amplitude calibrator 36 are adjusted to establish appropriate RIT operating conditions, i.e. to provide a low-impedance differential $e_s$ and $\bar{e}_s$ signal operating at a carrier frequency of 500 kHz. It should be appreciated that the quiescent operation level is optimally maintained by the direct drive operating format provided by sensing circuit 12. Subsequent to attaining setup sensor operation, the net difference AC current ($\Delta i_s$), caused by the electromagnetic operation and push-pull sensor head to target distance variance, is transmitted through coaxial line 85 and node 86 to demodulating circuit 14. In the present example, it is assumed that the offset current, $\Delta i_e$, the current transmitted via precision gain cell 132 to node 86, is initially zero.

Receiving amplifier 88 converts net difference sensing current $\Delta i_s$ to an AC modulating voltage output.

The output of receiving amplifier 88 is sampled by sampling sub-circuit 90 to convert the peak values of the AC output modulating voltage to DC voltage stimulus. It should be appreciated that sampling occurs in a net zero volt recovered mode, so that capacitive charge leakage is minimized and dynamic range of temperature performance is extended relative to arrangements without the zero volt mode.

The stimulus drives integrator 116 when the difference between the stimulus and ground, i.e., $\Delta e_i$, is nonzero. The voltage output at TP1, i.e., $V_{TP1}$, is fed back through precision gain cell 132 and converted to offset current for combination or offsetting with $\Delta i_s$ at node 86. As the offset current is combined with $\Delta i_s$, the output from receiving amplifier 88 is level shifted as long as $\Delta e_i$ is nonzero. At any moment in time, the DC output at TP1 reflects the desired demodulated amplitude data imparted to the decoding network 10 via sensors 72 and 82 For example, in an RIT application in which sensors 72 a d 82 are provided to sense the position of an object therebetween, if the resultant signal yields a value of $\Delta e_i > 0$ then a change in the position of such object is indicated, and the amount of such change can be derived from the decoded, electrical equivalent signal at TP1.

The summation of the signals from demodulating circuit 14, precision output offset null cell 158 and feedback loop 189 is inputted to drive output buffer 188 which provides any necessary filtering and allows for low output impedance whereby high capacitive loads can be driven without oscillation. For loads located relatively near the decoding network 10, sense switch 193 is maintained in the "local" position and for loads located at relatively g.-eat distances from the decoding network 10, sense switch 193 is maintained in the "remote" condition. The output from signal processing circuit 16 is transmitted to the user via line 216.

In the foregoing description, it will be readily appreciated by those skilled in the art that modifications may be made to the invention without departing from the concepts disclosed herein. Such modifications are to be considered as included in the following claims unless these claims, by their language, expressly state otherwise.

The embodiments of the invention in which an exclusive property or privilege is claimed are defined as follows:

1. A network employing current sensing and analog signal decoding to measure a desired parameter, said network comprising:

first means for sensing the desired parameter and outputting a first current signal related to a unit measure of the desired parameter, said first means including a first sensor for producing a first sensor signal, a second sensor for producing a second sensor signal, and drive means for providing said first sensor with a first drive signal having a predetermined carrier frequency and said second sensor with a second drive signal having said predetermined carrier frequency; and second means, responsive to said first current signal, for demodulating said first current signal to obtain a demodulated signal having a component that reflects the unit measure of the desired parameter, said second means including feedback means for generating an offset signal having a component proportional to said component of said demodulated signal and combining said offset signal with said first current signal to provide a resultant signal having a component that reflects the unit measure of changes in the desired parameter.

2. The network of claim 1, wherein:

said first drive signal is phase shifted by approximately 180° relative to said second source drive signal.

3. The network of claim 1, wherein:

at least one of said said first sensor and said second sensor includes a capacitive probe type sensor operating at said predetermined carrier frequency.

4. The network of claim 1, wherein said feedback means includes:

means for providing linear amplification to said offset signal, said means for providing linear amplification including a digital-to-analog converter.

5. The network of claim 1, wherein said drive means includes:

precision drive means for providing said first and second drive signals with a substantially constant AC voltage amplitude and a substantially constant frequency.

6. The network of claim 1, wherein, in the absence of a change in the unit measure of the desired parameter, the value of said resultant signal is substantially equal to a known reference value and said demodulated signal remains substantially constant.

7. The network of claim 1, wherein:

said second means includes means for providing a DC bias to said demodulated signal to compensate for known variations in network operation over a predetermined control range.

8. The network of claim 1, wherein:

said second means includes means for amplifying said demodulated signal to compensate for losses encountered by said demodulated signal as said demodulated signal is transmitted over distances.

9. The network of claim 1, further comprising:

said second means includes transfer function modifier means for dynamic modification of said demodulated signal.

10. A network employing current sensing and analog signal decoding to measure a desired parameter associated with an object, said network comprising:

a first reflected impedance transducer (RIT) for producing a first RIT signal and a second RIT sensor for producing a second RIT signal, wherein said first RIT and said second RIT are each driven at a predetermined carrier frequency to establish proper magnetization coupling with the object;

establishing means, operatively communicating with said first and second RIT sensors for providing said first RIT sensor with a first drive signal having said predetermined carrier frequency and said second RIT sensor with a second drive signal having said predetermined carrier frequency and substantially 180° out of phase with said first drive signal; and combining means for combining said first RIT signal with said second RIT signal to produce a first current signal, wherein the portions of said first sensor signal and said second sensor signal at said predetermined carrier frequency are substantially eliminated from said first current signal;

demodulating means, responsive to said first current signal, for demodulating said first current signal to obtain a demodulated signal having a component that reflects the unit measure of the desired parameter;

wherein said demodulating means includes:

feedback means for generating a second current signal having a component proportional to said component of said demodulated signal and combining said second current signal with said first current signal to provide a resultant current signal having a component that reflects the unit measure of changes in the desired parameter, wherein said feedback means has a substantially linear transfer function;

converting means for converting said resultant current signal to a corresponding resultant voltage signal;

sampling means for sampling said resultant voltage signal to generate a sampled signal, wherein said sampling means includes a capacitor that operates in a substantially net zero volt mode;

synchronizing means for synchronizing operation of said sampling mans with said establishing means wherein said resultant voltage signal is sampled at predetermined intervals such that phase correlation demodulation is achieved; and integrating means, responsive to said sampled signal, for integrating said sampled signal to provide said demodulated output signal.

11. A method for measuring desired parameters by employing low impedance current sensing and analog signal decoding, said method comprising the steps of:

providing sensing means for sensing the desired parameter and producing a current signal relating to the desired parameter;

sensing the desired parameter and producing said current signal related to the desired parameter; and wherein said sensing means includes a first sensor for providing a first sensor signal and a second sensor for providing a second sensor signal;

transmitting a first drive signal having a predetermined frequency to said first sensor; and transmitting a second drive signal that has substantially said predetermined frequency and is phase shifted by approximately 180° relative to said first drive signal to said second sensor;

demodulating said current signal to obtain a demodulated signal having a component that reflects a unit measure of the desired parameter, wherein said step of demodulating includes:

generating an offset signal proportional to said component of said demodulated output signal;

combining said offset signal with said current signal to provide a resultant alternating signal having a component that reflects changes in the unit measure of the desired parameter;

sampling said resultant alternating signal to produce a sampled signal.

12. The network of claim 1, wherein:

said drive means includes means for adjustably defining the amplitude of at least one of said first drive signal and said second drive signal.

13. The network of claim 1, wherein:

said drive means includes a low-impedance driver.

14. The network of claim 1, wherein:

said drive means includes means for establishing a substantially matching impedance relationship with at least one of said first sensor and said second sensor.

15. The network of claim 14, wherein:

said means for establishing a substantially matching impedance relationship includes a capacitor.

16. The network of claim 1, wherein:

at least one of said first sensor and said second sensor includes a reflected impedance transducer.

17. The network of claim 1, wherein:

said first means includes means for combining said first sensor signal with said second sensor signal to produce a differential signal, wherein the portions of said first sensor signal and said second sensor signal at said predetermined carrier frequency are substantially eliminated from said differential signal.

18. The network of claim 1, wherein:

said offset signal is a second current signal and said resultant signal is a resultant current signal.

19. The network of claim 18, wherein:

said second means includes means for converting said resultant current signal to a corresponding resultant voltage signal.

20. The network of claim 19, wherein:

said second means includes means for sampling said resultant voltage signal to produce a sampled signal.

21. The network of claim 20, wherein:

said second means includes means for integrating said sampled signal.

22. The network of claim 19, wherein:

said second means includes means for integrating said resultant voltage signal.

23. The network of claim 1, wherein:

said second means includes means for achieving synchronous operation with said driver means to accomplish phase correlated demodulation.

24. The network of claim 1, wherein:

said second means includes capacitor means for use in sampling said resultant signal, wherein said capacitor means operates in a substantially net zero volt mode.

25. The network of claim 7, wherein:

said means for providing a DC bias includes a programmable offset calibrator.

26. The network of claim 9, wherein:

said transfer function modifier means includes means for linearizing said demodulated signal.

27. The method of claim 11, wherein said step of sensing includes:

combining said first signal and said second signal to generate a differential signal, wherein the portions of said first sensor signal and said second sensor signal signals at said predetermined frequency are substantially eliminated from said differential signal.

* * * * *